US005344256A

United States Patent [19]

Hedrick

[11] Patent Number: 5,344,256

[45] Date of Patent: Sep. 6, 1994

[54] ROCK ANCHOR AND METHOD OF MANUFACTURE

[75] Inventor: Neville A. Hedrick, Fadbury, Australia

[73] Assignee: Garford Pty Ltd, Lansdale, Australia

[21] Appl. No.: 63,129

[22] Filed: May 13, 1993

Related U.S. Application Data

[63] Continuation of Ser. No. 679,037, May 14, 1991, abandoned.

[30] Foreign Application Priority Data

Nov. 14, 1988 [AU] Australia ..... PJ1416

[51] Int. Cl.[5] ..... E21D 20/00

[52] U.S. Cl. ..... 405/259.1; 405/258; 29/461; 72/302

[58] Field of Search ..... 405/259.1, 259.3, 259.5, 405/258; 29/461; 72/302

[56] References Cited

U.S. PATENT DOCUMENTS

| | | | |
|---|---|---|---|
| 3,910,092 | 10/1975 | Jury et al. | 72/302 |
| 4,150,473 | 4/1979 | Dietrich | 29/461 |
| 4,360,292 | 11/1982 | Keeler et al. | 405/259.5 X |
| 4,449,855 | 5/1984 | Langwadt | 405/259.5 |
| 4,469,756 | 9/1984 | Jungwirth et al. | 29/461 X |
| 4,492,015 | 1/1985 | Dearman . | |
| 4,507,008 | 3/1985 | Adl et al. | 29/461 X |
| 4,617,715 | 10/1986 | Koistinen et al. | 405/259.1 X |
| 4,625,533 | 12/1986 | Okada et al. | 72/302 |
| 4,722,468 | 2/1988 | McClure . | |
| 4,750,662 | 6/1988 | Kagimoto . | |
| 4,773,247 | 9/1988 | Zöls | 29/461 X |
| 4,790,129 | 12/1988 | Hutchins | 405/259.5 X |
| 4,798,501 | 1/1989 | Spies | 405/259.1 X |

FOREIGN PATENT DOCUMENTS

| | | |
|---|---|---|
| 42268 | 11/1973 | Australia . |
| 79763 | 8/1982 | Australia . |
| 42734 | 11/1985 | Australia . |
| 56559 | 8/1986 | Australia . |
| 1546511 | 4/1969 | France . |
| 975642 | 11/1964 | United Kingdom . |
| 1024696 | 3/1966 | United Kingdom . |
| 2034623 | 6/1980 | United Kingdom . |
| 1591698 | 6/1981 | United Kingdom . |
| 2144784 | 3/1985 | United Kingdom . |
| 2165787 | 4/1986 | United Kingdom . |

*Primary Examiner*—Randolph A. Reese
*Assistant Examiner*—J. Russell McBee
*Attorney, Agent, or Firm*—Reising, Ethington, Barnard, Perry & Milton

[57] ABSTRACT

A rock anchor is formed from a tendon composed of a plurality of strands. The tendon has at least one bulbous portion wherein all the strands in the bulbous portion are spaced apart from one another substantially around the periphery of each bulbous portion. An apparatus for manufacturing the rock anchor includes a series of opposed plates disposed on opposite sides of the tendon and controlled by respective hydraulic rams to clamp the tendon between the opposing plates. The clamps are sequentially displaced longitudinally by a dedicated hydraulic ram to form the bulbous portion between adjacent clamps.

11 Claims, 8 Drawing Sheets

ROCK ANCHOR AND METHOD OF MANUFACTURE

This application is a continuation of application Ser. No. 679,037, filed May 14, 1991 now abandoned.

FIELD OF THE INVENTION

The present invention relates to an improved rock anchor and a method of and an apparatus for manufacture thereof. Rock anchors are steel tendons inserted down bore holes in a scree. A portion of the tendon is grouted, and a plate attached to the tendon. The tendon is then stressed; the plate bears upon the scree and thereby stabilizes the scree.

Tendons typically comprise a plurality of steel strands wound together to form the tendon. To adequately secure such tendons in cement, prior art methods have used machines to unravel the strands. Such machines have required people to initiate such unravelling prior to insertion into the machine. This is time consuming and hence expensive. The purpose of unravelling the strands is to increase the surface area of the tendon in contact with the cement to more securely embed the tendon in the cement.

The present invention provides an alternative form of tendon and a method and an apparatus for manufacture thereof.

SUMMARY OF THE INVENTION

In accordance with one aspect of the present invention there is provided a rock anchor characterized in that it comprises a tendon having a plurality of outer strands helically wound around a center strand, the tendon having at least one bulbous portion, wherein all the outer strands and the center strand in said bulbous portion are spaced apart from one another substantially at the periphery of said bulbous portion.

In accordance with another aspect of the present invention there is provided an apparatus for manufacturing a rock anchor characterized in that it comprises at least two clamp means spaced apart and movable relative to one another and able to clamp a tendon, and a clamp displacement means arranged to displace the clamp means relative to one another, wherein each clamp means comprises a ram means bearing a plate and arranged to clamp the tendon against an opposed plate.

In accordance with yet another aspect of the present invention there is provided a method for manufacturing a rock anchor characterized by clamping a tendon in two or more spaced clamp means movable relative to one another, relatively displacing the clamp means towards one another to form at least one bulbous portion in the tendon, and releasing the tendon from the clamp means.

BRIEF DESCRIPTION OF THE DRAWINGS

The present invention will now be described, by way of example, with reference to the accompanying drawings, in which.

DESCRIPTION OF THE INVENTION

Figure 1:
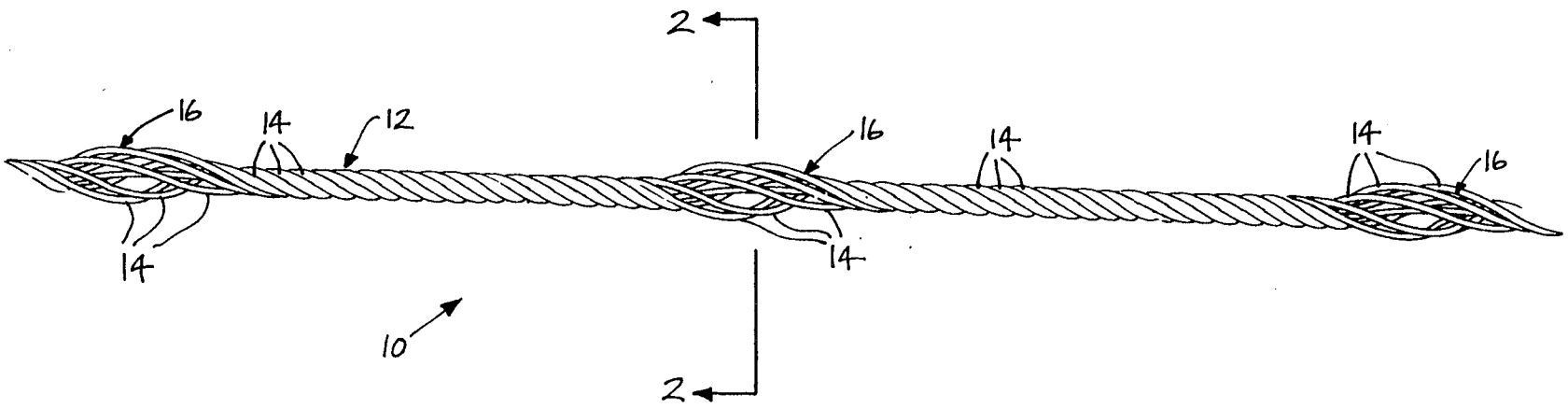
FIG. 1 is a view of a rock anchor in accordance with the present invention.
Figure 2:
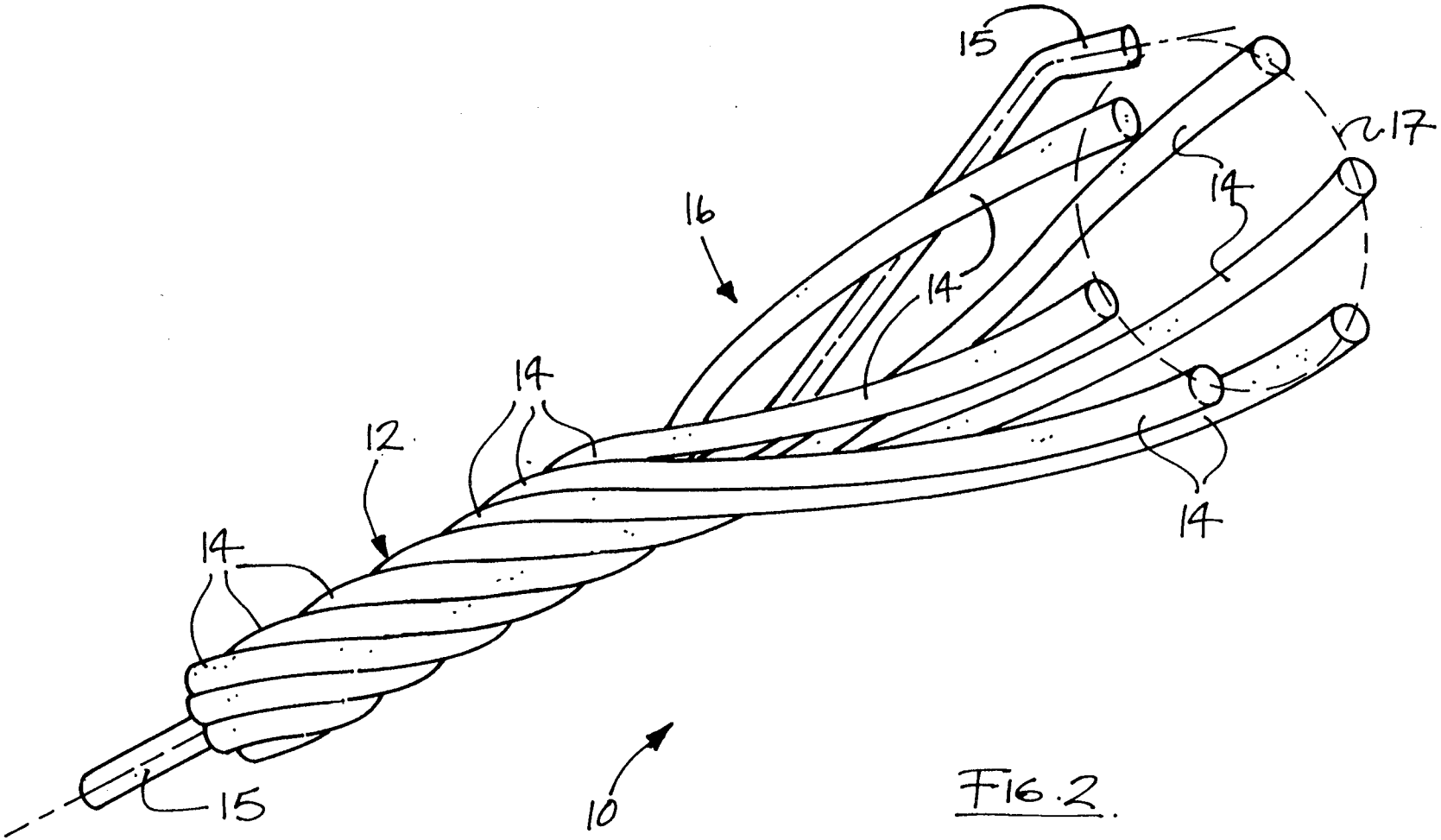
FIG. 2 is an upper perspective view of a section taken along the line 2—2 of FIG. 1.

Shown in FIGS. 1 and 2 is a rock anchor 10 comprising a steel tendon 12. The tendon 12 is composed of a plurality of outer strands 14 helically wound around a center strand 15 to form the tendon 12. As shown, there are six outer strands 14 wound around the center strands. The tendon 12 has a plurality of bulbous portions 16 spaced apart from one another along the length of the tendon.

The portions of the strands 14 and 15, in the bulbous portions 16, are spaced apart from each other around the circumference of the bulbous portions 16, as shown. The section line 2—2 has been taken through the fattest part of the bulbous portion 16. As seen in FIG. 2, the center strand 15 is displaced away from the center of the tendon 12. Each bulbous portion 16 has a bulb diameter defined as the diameter of the smallest tube through which the rock anchor 10 will pass. The bulb periphery is indicated by the broken lines, marked 17 in FIG. 2. The outer strands 14 and the center strand 15 are all located adjacent and within the bulb periphery 17.

This enables cement to contact a greater surface area of the strands 14 in use, as hereinbefore described. The rock anchor 10 is thereby firmly embedded in the cement. Furthermore, the center strand 15 is displaced away from its normal central position, in the bulbous portions 16. When the rock anchor 10 is stressed, the lead will be taken more evenly by the strands 14 and 15 than if the center strand 15 was in its central position. If the center strand 15 was in its central position, more lead would be taken by the center strand 15 than the outer strands 14. This would then lower the safety factor of the rock anchor 10 which could then fail at a much lower lead.

Figure 3:
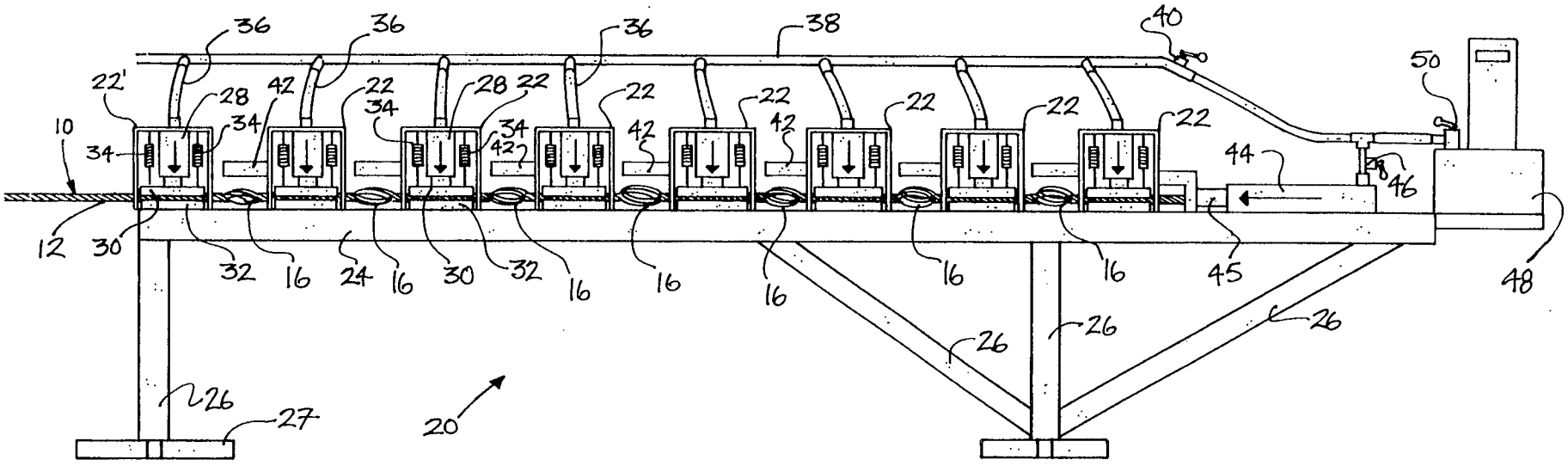
FIG. 3 is a side view of a first embodiment of a machine for manufacturing a rock anchor in accordance with the present invention.

Shown in FIG. 3 is a first embodiment of an apparatus 20 for manufacturing a rock anchor 10. The apparatus 20 comprises a plurality of spaced clamp means 22 to clamp the tendon 12. The spacing between adjacent clamp means 22 is initially set at a first predetermined distance. This first predetermined length corresponds to an uninterrupted length of tendon 12 necessary to form a bulbous portion 16 having the correct or desired proportions. The clamp means 22 are slidably mounted on a frame 24 supported by legs 26 and feet 27. One of the clamp means 22' is fixed to the frame 24. As shown, the fixed clamp means 22' is located at one end of the frame 24, in this case the left hand end, as shown in FIG. 3.

Each clamp means 22 comprises an hydraulic ram 28 having a plate 30 attached thereto to bear on and thereby clamp the tendon 12 against an opposed plate 32. Springs 34 are provided to help bias the plates 30 and 32 apart when the ram 28 is released. Each ram 28 is supplied with hydraulic pressure through a pipe 36 connected to a common manifold 38 and controlled by a valve 40. Each clamp means 22 is provided with a stop 42 extending to the left, as shown, to limit movement of the plurality of clamp means 22 relative to each other.

A clamp displacement means such as an hydraulic ram 44 is fixed to the right hand end of the frame 24 and is controlled by a valve 46. The ram 44 has a plunger 45 which bears on the clamp means 22 on the right, as shown in FIG. 2. The ram 44 is able to displace the plurality of clamp means 22 relative to one another.

An hydraulic power source 48 supplies hydraulic pressure to the rams 28 and 44 and is controlled by a valve 50. In use, a tendon 12 is placed between the plates 30 and 32, of each clamp means 22. The valves 40 and 50 are then opened to operate the rams 28. The rams 28 move the plates 30 to bear on the tendon 12 and thereby clamp the tendon 12 against the opposed plates 32.

The valve 46 is then opened to operate the ram 44. The ram 44 bears on the clamp means 22 on the right and displaces it towards the left. Since the clamp means 22' is fixed to the frame 24, the other clamp means 22 are displaced relative to one another. Such relative displacement causes the tendon 12 to be interrupted and the bulbous portions 16 to be formed in the tendon 12, between adjacent clamp means 22. Thus, it is apparent that the right hand clamp 22 is moved to the left as seen in FIG. 3 before any of the other clamps 22 commence to move. This causes the first bulbous portion 16 to be formed in the tendon 12. Subsequently the stop 42 of the right hand clamp 22 contacts the next clamp 22 to the left. Thus, the next clamp 22 is caused to move towards the left as seen in FIG. 3 and to cause the second bulbous portion 16 to be formed in the tendon 12. This sequential mode of operation is continued until all of the steps 42 are in contact with the next clamps 22 to the left as seen in FIG. 3 and until the left hand stop 42 contacts the fixed clamp 22'. Thus, the bulbous portions 16 are produced in sequence by the sequential movement of the clamps 22.

The stops 42 limit the displacement of one clamp means 22 relative to adjacent clamp means 22. Conveniently, the stops 42 limit the distance between adjacent clamp means 22 to a second predetermined distance. This second predetermined distance corresponds to the bulbous portions 16 reaching their correct or desired proportions. Displacement of the ram 44 is continued until bulbous portions 16 of sufficient size and shape are formed. This may occur when each stop 42 contacts an adjacent clamp means 22 and movement of the clamp means 22 relative to one another is no longer possible.

When the tendon 12 is axially compressed in the above manner to form the bulbous portions 16, the strands 14 are forced apart and the strand 15 is forced outwardly to a position adjacent the bulb periphery 17 as described above and a rock anchor 10 in accordance with the present invention is formed.

The valves 40 and 46 are then closed. The springs 34 of the clamp means 22 urge the plates 30 away from the plates 32, thereby releasing the tendon 12. The rock anchor 10 is then removed and may be used in known manner.

Shown in FIGS. 4, 5, 7 and 8 is a second embodiment of an apparatus 52 for manufacturing a rock anchor 10. Reference numerals used in FIG. 3 denote like parts in FIGS. 4, 5, 7 and 8. As is apparent, there is only one slidable clamp means 22. This clamp means 22 is held in a carriage 54 slidable along the frame 24. The hydraulic ram 28, associated with the fixed clamp means 22', is supplied with hydraulic pressure through a pipe 56. The ram 28, associated with the slidable clamp means 22, is supplied with hydraulic pressure through a separate pipe 58. Similarly, the ram 44 of the displacement means, has a separate pipe 60 to supply hydraulic pressure. The pipes 56, 58 and 60 are connected to an hydraulic timer (not shown) which co-ordinates the action of both rams 28 and the ram 44.

Figure 4:
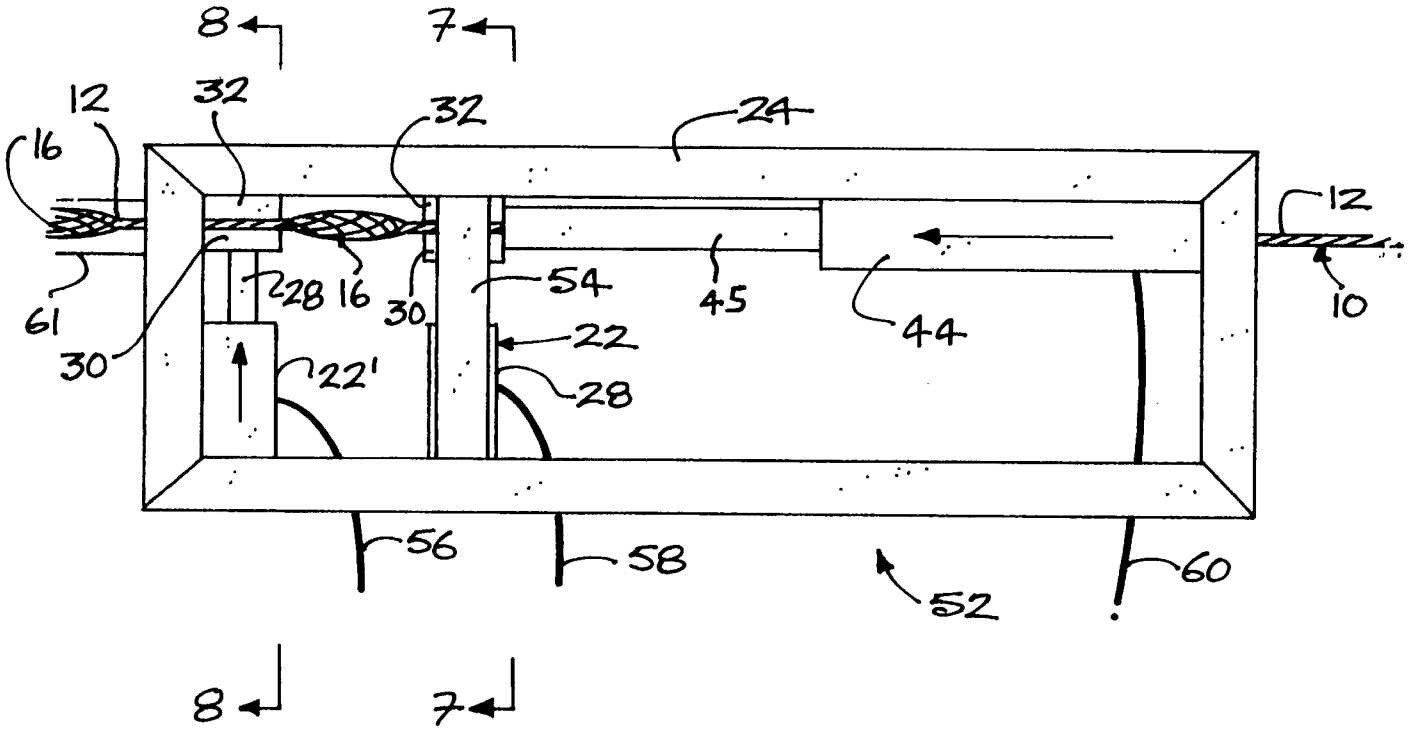
FIG. 4 is a plan view of a second embodiment of a machine for manufacturing a rock anchor in accordance with the present invention in a bulb upsetting condition.
Figure 5:
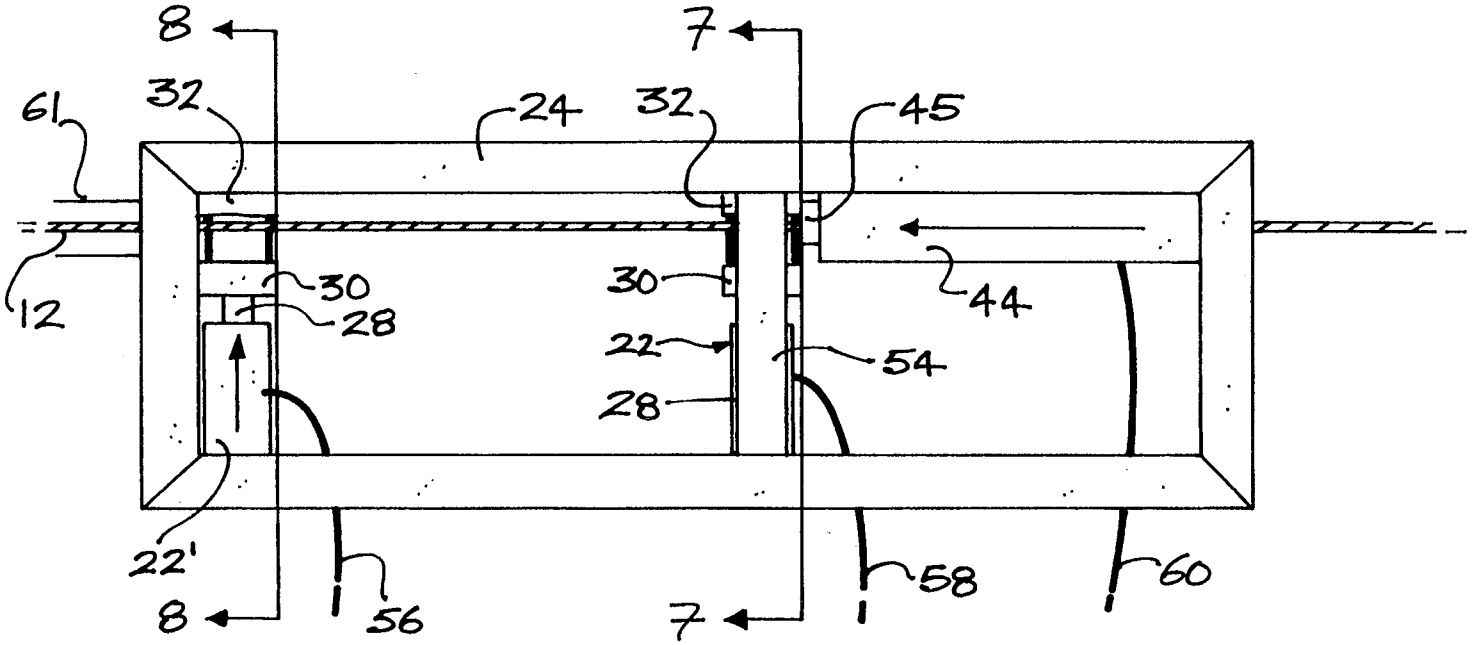
FIG. 5 is a plan view of the machine of FIG. 4 in a tendon displacing condition.

As shown, the tendon 12 passes through the center of the ram 44. The plunger 45 is attached to the plates 30 and 32 of the fixed clamp means 22, on the right as shown in FIG. 4. A straight pipe 61 is disposed to the left of the fixed clamp 22 and is arranged to receive the rock anchor 10. The pipe 61 has a diameter at least that of the bulb diameter, as defined hereinbefore.

Figure 8:
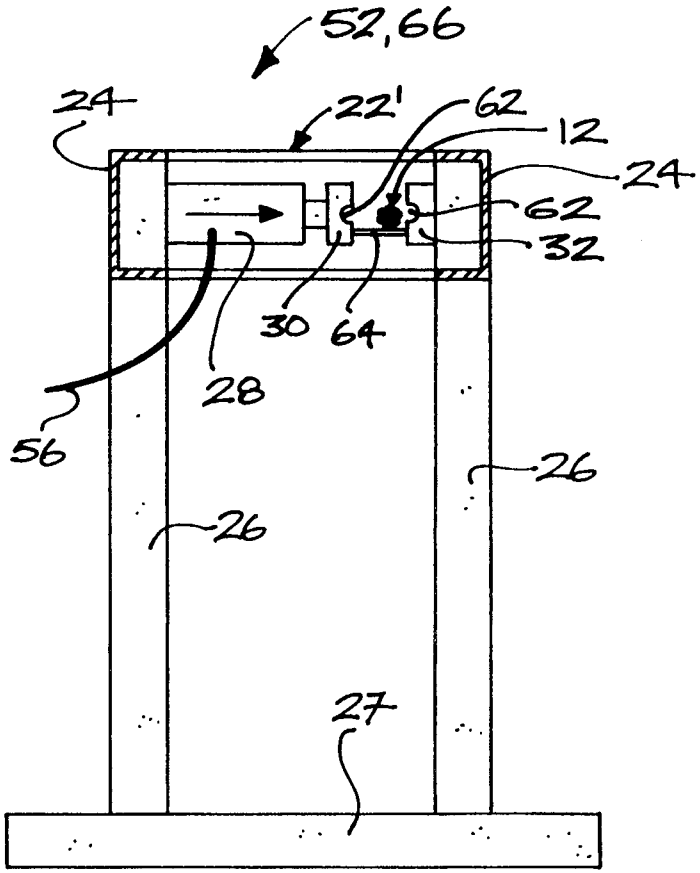
FIG. 8 is a transverse sectional view along lines 8—8 of FIGS. 4 to 6.
Figure 7:
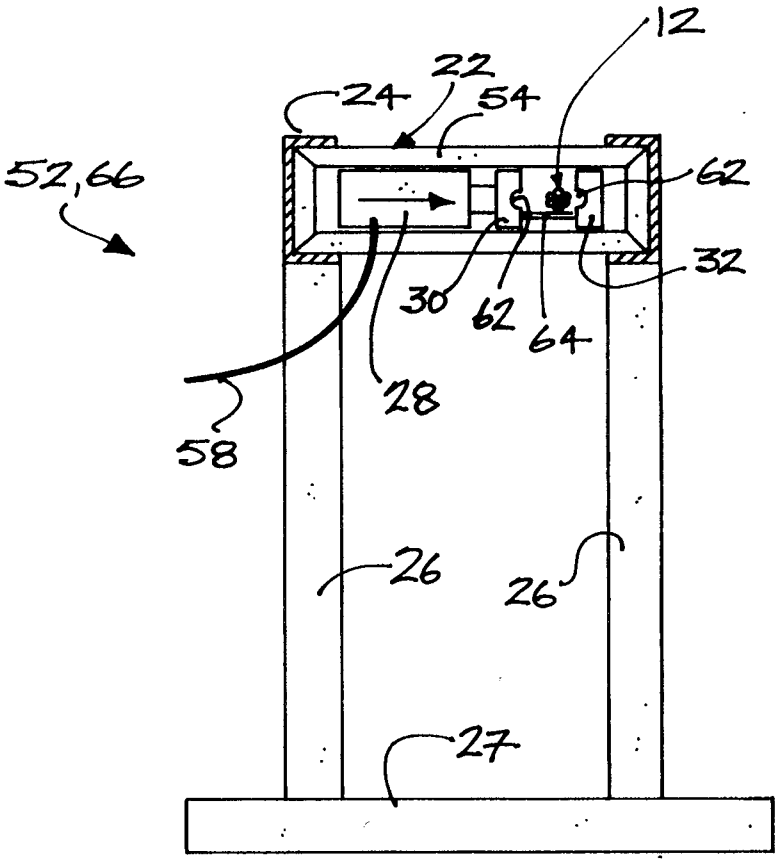
FIG. 7 is a transverse sectional view along lines 7—7 of FIGS. 4 to 6.

As seen in FIGS. 7 and 8, each plate 30 and 32 has a recess 62. The plates 30 and 32 have a centralizing pin 64 located below the recesses 62 and extending between the plates 30 and 32. The pin 64 serves to support the tendon 12 and to guide the plates 30 and 32 toward one another so that the recesses 62 clamp the tendon 12 therein. Thus, the plate 30 contains a recess (not shown) which receives the pin 64 when the plates 30 and 32 are moved together by the ram 28.

In use, a tendon 12 is first fed through the ram 44, between the plates 30 and 32, of the clamp means 22 and 22', and into the pipe 61.

The hydraulic timer operates and activates the ram 28, of the fixed clamping means 22'. This results in the clamping means 22' securely holding the tendon 12 by means of the plates 30 and 32.

At this point, the ram 28, of the slidable clamp means 22, is deactivated to allow the tendon 12 to slide between its plates 30 and 32.

The ram 44 is then activated and causes the plunger 45 to move to the left, toward the fixed clamp means 22'. This moves the carriage 54, with the slidable clamp means 22, to the left, toward the fixed clamp means 22'. When the distance between the clamp means 22 and 22' reaches the first predetermined length as defined hereinbefore, the ram 44 is deactivated.

The ram 28, of the slidable clamp means 22, is then activated to clamp the tendon 12 between the plates 30 and 32.

The ram 44 is then reactivated. This causes the plunger 45 to bear upon the plates 30 and 32, of the slidable clamp means 22, and displace the slidable clamp means 22 towards the fixed clamp means 22'. Such relative displacement causes the bulbous portions 16 to be formed in the tendon 12 between the clamp means 22 and 22'.

When the distance between the clamp means 22 and 22' reaches the second predetermined distance (as defined hereinbefore) the ram 28, of the slidable clamp means 22, and the ram 44 are then deactivated to release the tendon 12.

The ram 44 then withdraws the plunger 45 away from the fixed clamp means 22'. This moves the carriage 54 with the slidable clamp means 22, to the right, away from the fixed clamp means 22'.

The ram 28, of the slidable clamp means 22, is then activated to clamp the tendon 12 by means of the plates 30 and 32.

The ram 28, of the fixed clamp means 22', is then deactivated to release the tendon 12.

The ram 44 is then activated, the plunger 45 extends and moves the carriage 54 and slidable clamp means 22 towards the fixed clamp means 22'. Thus, in this condition, the slidable clamp means 22 and the ram 44 function as a tendon displacement means to move the tendon 12. This also moves the rock anchor 10 to the left and into the straight pipe 61. The pipe 61 generally straightens out any bends that may have occurred when the bulbous portion 16 was formed. When the rock anchor 10 has been moved a distance equal to the spacing between adjacent bulbous portions 16, the ram 44 is then deactivated to prevent any further movement of the tendon 12.

The ram 28, of the fixed clamping means 22' is then activated and the process is repeated as many times as is required.

Figure 6:
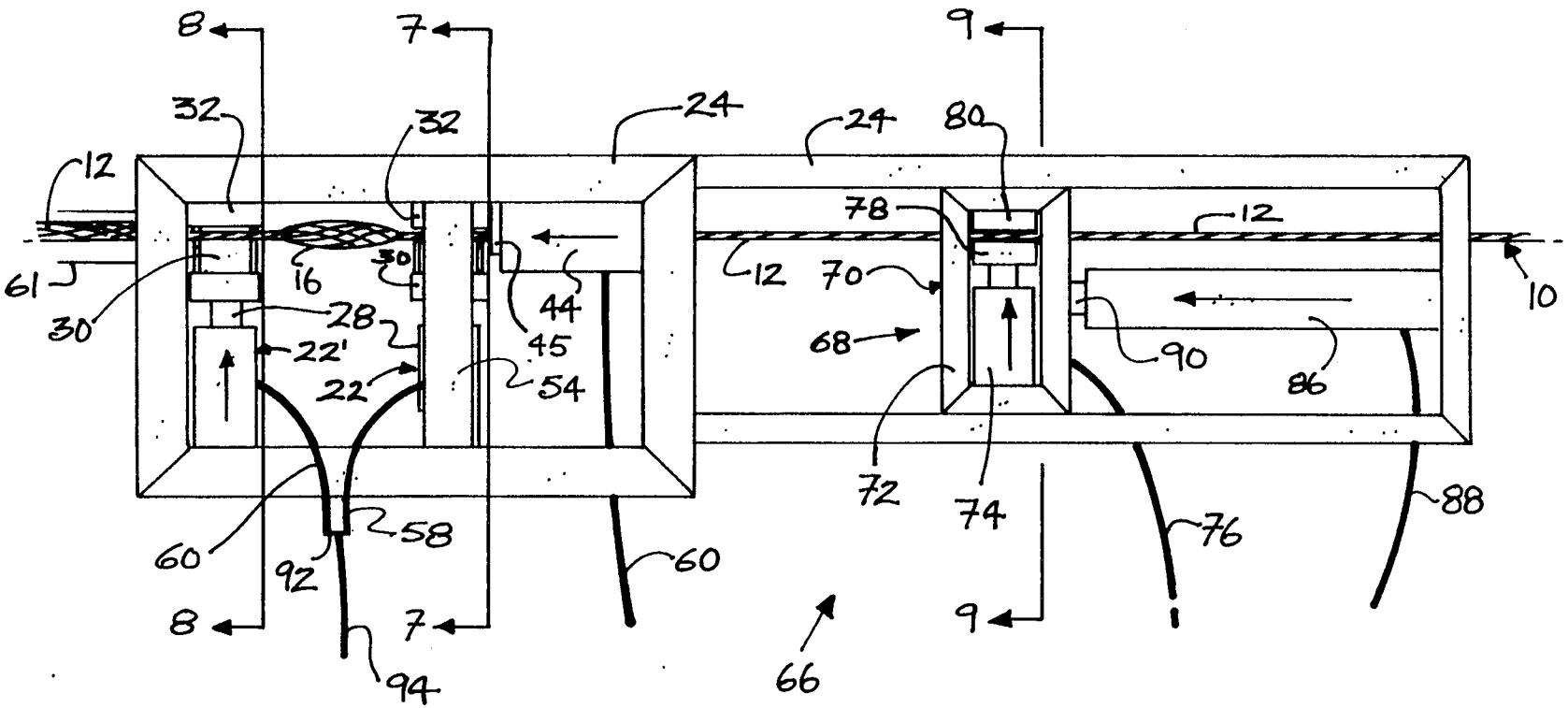
FIG. 6 is a plan view of a third embodiment of a machine for manufacturing a rock anchor in accordance with the present invention in a bulb upsetting condition.
Figure 9:
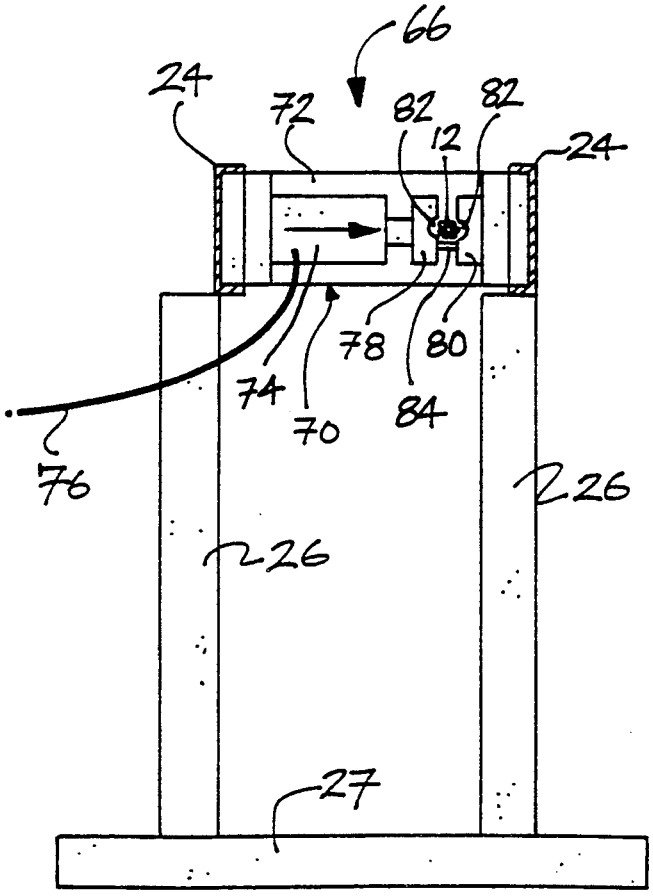
FIG. 9 is a transverse sectional view along line 9—9 of FIG. 6.

Shown in FIGS. 6 and 9 is a third embodiment of an apparatus 66 for manufacturing a rock anchor 10 which is a modification of the apparatus 52 of FIGS. 4, 5, 7 and 8. Like numerals denote like parts. The apparatus 66 additionally comprises a tendon displacement means 68 to the right of the slidable clamp means 22 in FIG. 6. The tendon displacement means 68 comprises a slidable clamp means 70 carried by a carriage 72 slidable along the frame 24. The clamp means 70 comprises an hydraulic ram 74 supplied with hydraulic pressure by a pipe 76. The ram 74 has a plate 78 attached thereto to bear on and thereby clamp the tendon 12 against an opposed plate 80. Each plate 78 and 80 has a recess 82, in a similar manner to the machine 52 of FIGS. 4, 5, 7 and 8. The plates 78 and 80 have a centralizing pin 84 located below the half recesses 82, in a similar manner to the machine 52 of FIGS. 4, 5, 7 and 8. The tendon displacement means 68 further comprises a clamp displacement means in the form of an hydraulic ram 86 supplied with hydraulic pressure through a pipe 88. The ram 86 has a plunger 90 which bears on the carriage 72 and is arranged to displace the sliding clamp means 70 to the left, as shown in FIG. 6.

As is apparent, the tendon displacement means 68 is a separate item, as compared to the tendon displacement means of the apparatus 52.

The pipes 58 and 60 are connected to a common manifold 92 supplied with hydraulic pressure by a pipe 94. Thus, the fixed clamp means 22' and the slidable clamp means 22 are activated simultaneously.

In use, a tendon 12 is first fed through between the plates 78 and 80, through the ram 44, between the plates 30 and 32, of the clamp means 22 and 22' and into the plate 61.

An hydraulic timer operates and simultaneously activates both of the rams 28 so that the clamps 22 and 22' securely hold the tendon 12.

At this point, the ram 86 is reactivated to allow the tendon 12 to slide between the plates 78 and 80. Further, at this stage, the clamp means 22 and 22' are the first predetermined distance (as defined hereinbefore) apart. The ram 44 is then activated to move the carriage 54 to the left, towards the fixed clamp means 22'. This relative displacement interrupts the tendon 12 and forms a bulbous portion 16. When the distance between the clamp means 22 and 22' reaches the second predetermined distance (as defined hereinbefore) both rams 28 and the ram 44 are deactivated.

Ram 74 is then activated so that the tendon 12 is securely held in the slidable clamp means 70 by the plates 78 and 80. The ram 86 is then activated and the plunger 90 moves the carriage 72 to the left, towards the fixed clamp means 22'. This also moves the rock anchor 10 to the left and into the straight pipe 61.

When the rock anchor 10 has been moved a distance equal to the spacings between adjacent bulbous portions 16, the rams 74 and 86 are deactivated.

Both rams 28 are then simultaneously activated and the process is repeated as many times as desired.

The present invention provides a rock anchor which is easily manufactured and does not require unravelling of the strands, and more rock anchors may be produced in the same time as compared to prior art systems.

With the rock anchor of the present invention, the strands in the bulbous portions are separated and hence the rock anchor will be firmly embedded in the cement in the bore hole.

Finally, it is envisaged that the tendon displacement means may alternately comprise an electric motor driving a wheel. An idler wheel would bear upon the driven wheel and the tendon would pass between the idler and driven wheels. A timer would activate an electric motor to rotate the driven wheel and thereby move the tendon.

Modifications and variations such as would be apparent to a skilled addressee are deemed within the scope of the present invention. For example, there may be a number of each of the machines 20, 52 and 66 operating simultaneously together in parallel. Further, the machine 20 may be provided with a hydraulic timer to co-ordinate the activation of the rams 28 and 44. Even further, the ram 44 may have an adjustment means in the form of a threaded column to vary the position of the ram 44 along the frame.

I claim:

1. An apparatus for manufacturing a rock anchor comprising a tendon composed of a plurality of strands, the tendon having at least one bulbous portion wherein all the strands in the bulbous portion are spaced apart from one another substantially around the periphery of each bulbous portion characterized in that the apparatus comprises at least two first clamp means spaced apart and movable relative to one another and able to clamp a tendon, and a clamp displacement means arranged to displace the first clamp means relatively towards one another so as to form a bulbous portion in a clamped tendon, each first clamp means comprising a hydraulic ram means bearing a plate arranged to clamp the tendon against an opposed plate, wherein there is also provided a tendon displacement means arranged to displace the tendon longitudinally relative to the first clamp means after a bulbous portion has been formed in the tendon, the tendon displacement means comprising a second clamp means arranged to grip the tendon for longitudinal displacement of the tendon, the second clamp means of the tendon displacement means being separate from the first clamp means used for formation of the bulbous portion.

2. An apparatus according to claim 1, characterized in that one of the first clamp means is fixed relative to the apparatus and the other first clamp means is movable.

3. An apparatus according to claim 2, characterized in that the clamp displacement means comprises a hydraulic ram arranged to displace the movable first clamp means towards the fixed first clamp means.

4. An apparatus according to any one of claims 2 or 3, characterized in that said movable first clamp means is carried in a carriage slidable along a frame of the apparatus.

5. An apparatus according to claim 1, characterized in that the plates of each first clamp means has a recess arranged to receive the clamped tendon.

6. An apparatus according to claim 1, characterized in that there is provided a centralizing pin associated with the plates in the first clamp means to support the tendon and guide the plates toward one another.

7. An apparatus according claim 1, characterized in that each first clamp means comprises a spring means arranged to bias the plates apart.

8. An apparatus according to claim 1, characterized in that the first clamp means are provided with stops to limit displacement thereof relative to the other clamp means.

9. An apparatus according to claim 1, characterized in that each first clamp means is spaced apart from the other first clamp means a first predetermined distance prior to forming a bulbous portion, the first predetermined distance corresponding to an uninterrupted length of tendon necessary to form a bulbous portion of selected proportions.

10. An apparatus according to claim 1, characterized in that each first clamp means is spaced apart from the other first clamp means a second predetermined distance after forming a bulbous portion, the second predetermined distance corresponding to the bulbous portion reaching the selected proportions.

11. An apparatus according to claim 1, characterized in that there is provided a substantially straight pipe arranged to receive and substantially straighten out the rock anchor.

* * * * *